US006533013B1

(12) United States Patent
Nix

(10) Patent No.: US 6,533,013 B1
(45) Date of Patent: Mar. 18, 2003

(54) ELECTRIC STRAPPING TOOL AND METHOD THEREFOR

(75) Inventor: Robert J. Nix, Algonquin, IL (US)

(73) Assignee: Illinois Tool Works Inc., Glenview, IL (US)

( * ) Notice: Subject to any disclaimer, the term of this patent is extended or adjusted under 35 U.S.C. 154(b) by 110 days.

(21) Appl. No.: 09/588,146

(22) Filed: Jun. 2, 2000

(51) Int. Cl.[7] ..... B65B 13/04

(52) U.S. Cl. ..... 156/361; 156/367; 156/368; 156/378; 156/494; 156/580; 53/399

(58) Field of Search ..... 53/399, 589, 592; 100/4, 48, 50; 156/494, 580, 73.5, 73.6, 361, 367, 368, 378, 495; 116/284

(56) References Cited

U.S. PATENT DOCUMENTS 3,654,033 A 4/1972 Angarola et al.
4,313,779 A 2/1982 Nix
4,439,654 A * 3/1984 Bresin et al. ..... 200/302.1
4,450,032 A * 5/1984 Wehr ..... 156/353
5,146,847 A * 9/1992 Lyon et al. ..... 100/2
5,169,480 A 12/1992 Toppel et al.
5,380,393 A 1/1995 Drabarek et al.
5,560,187 A * 10/1996 Nagashima ..... 53/589
5,853,524 A 12/1998 Nix

OTHER PUBLICATIONS

ITW Signode, VXL & VXM 2000–Z Tension Weld Strapping Tools, Operation, Parts and Safety Manual, 36 pgs., 1999.

* cited by examiner

*Primary Examiner*—Richard Crispino
*Assistant Examiner*—George R. Koch, III
(74) *Attorney, Agent, or Firm*—Donald J. Breh; Mark W. Croll; Lisa M. Soltis

(57) ABSTRACT

An electric strapping tools and methods therefor having an electric motor with an output shaft coupled to a feed wheel, a modulator circuit coupled to a power input of the motor for controlling strap tension. A magnet is disposed on an end of the motor armature and offset from the rotation axis thereof, and a magnetic field detector is disposed near magnet to detect rotation of the armature. The motor rotates the feed wheel and vibrates a welding jaw when the shaft rotates in the same direction, and tool parameter adjustment potentiometers are isolated from abuse by the tool user by corresponding control knobs coupled thereto.

26 Claims, 2 Drawing Sheets

ELECTRIC STRAPPING TOOL AND METHOD THEREFOR

BACKGROUND OF THE INVENTION

The invention relates generally to strapping tools, and more particularly to electric powered strapping tools.

Electric strapping tools are known generally, as disclosed for example in U.S. Pat. No. 4,313,779, entitled "All Electric Friction Fusion Strapping Tool", assigned commonly herewith. The exemplary prior art electric tool comprises a reversible electric motor that drives a strap tensioning feed wheel when the motor operates in one direction and vibrates a friction welder when the motor operates in an opposite direction. The motor reverses direction when a tension arm pivoted by tensioned strap disposed over a portion thereof actuates a limit switch of the tension arm. Strap tension is controlled by adjusting a set screw relative to the limit switch, which permits more or less pivoting of the tension arm by the tensioned strap before actuation of the limit switch.

An object of the present invention is to provide novel electric strapping tools and methods therefor that overcome problems in and improve upon the prior art.

Another object of the invention is to provide novel electric strapping tools and methods therefor that are economical and reliable.

Another object of the invention is to provide novel electric strapping tools and methods therefor that produce less heat and that do not overheat.

A further object of the invention is to provide novel electric strapping tools and methods therefor having user adjustable tool parameter control knobs that isolate and protect corresponding control devices housed in the strap tensioning tool.

It is also an object of the invention to provide novel electric tensioning tools and methods therefor that are more readily separated from tensioned straps after fastening.

Another object of the invention is to provide novel electric strapping tools having an electronics module with a rotation sensor mounted adjacent the electric motor.

A more particular object of the invention is to provide novel electric strapping tools and methods therefor comprising an electric motor having an output shaft coupled to a feed wheel, a modulator circuit coupled to a power input of the electric motor, whereby strap tension depends upon electric power supplied to the electric motor by the modulator circuit.

Another more particular object of the invention is to provide novel electric strapping tools and methods therefor comprising an electric motor having a rotatable shaft with an end substantially transverse to the rotation axis thereof, a magnet disposed on the end of the shaft and offset from the rotation axis thereof, a magnetic field detector disposed near the shaft, whereby rotation of the shaft is detectable by the magnetic field detector.

Another more particular object of the invention is to provide novel electric strapping tools and methods therefor comprising an electric motor having an output shaft coupled to a feed wheel and to a welding jaw, whereby the electric motor rotates the feed wheel and vibrates the welding jaw when the shaft thereof rotates in the same direction.

Yet another more particular object of the invention is to provide novel electric strapping tools and methods therefor comprising a strapping tool parameter adjustment member or device having a rotatable stem disposed at least partially in a housing of the tool, a portion of the stem of the adjustment member disposed in an opening of the control knob, and an annular resilient member disposed between and frictionally engaged with the stem and the control knob.

Still another more particular object of the invention is to provide novel electric strapping tools and methods therefor comprising tensioning strap with a feed wheel driven by an electric motor, sensing rotational output of the electric motor with a rotation detector positioned near an armature or shaft thereof, reducing power supplied to the electric motor when the rotational output thereof is reduced to a predetermined level sensed by the rotation detector, and maintaining strap tension by supplying reduced power to the electric motor.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
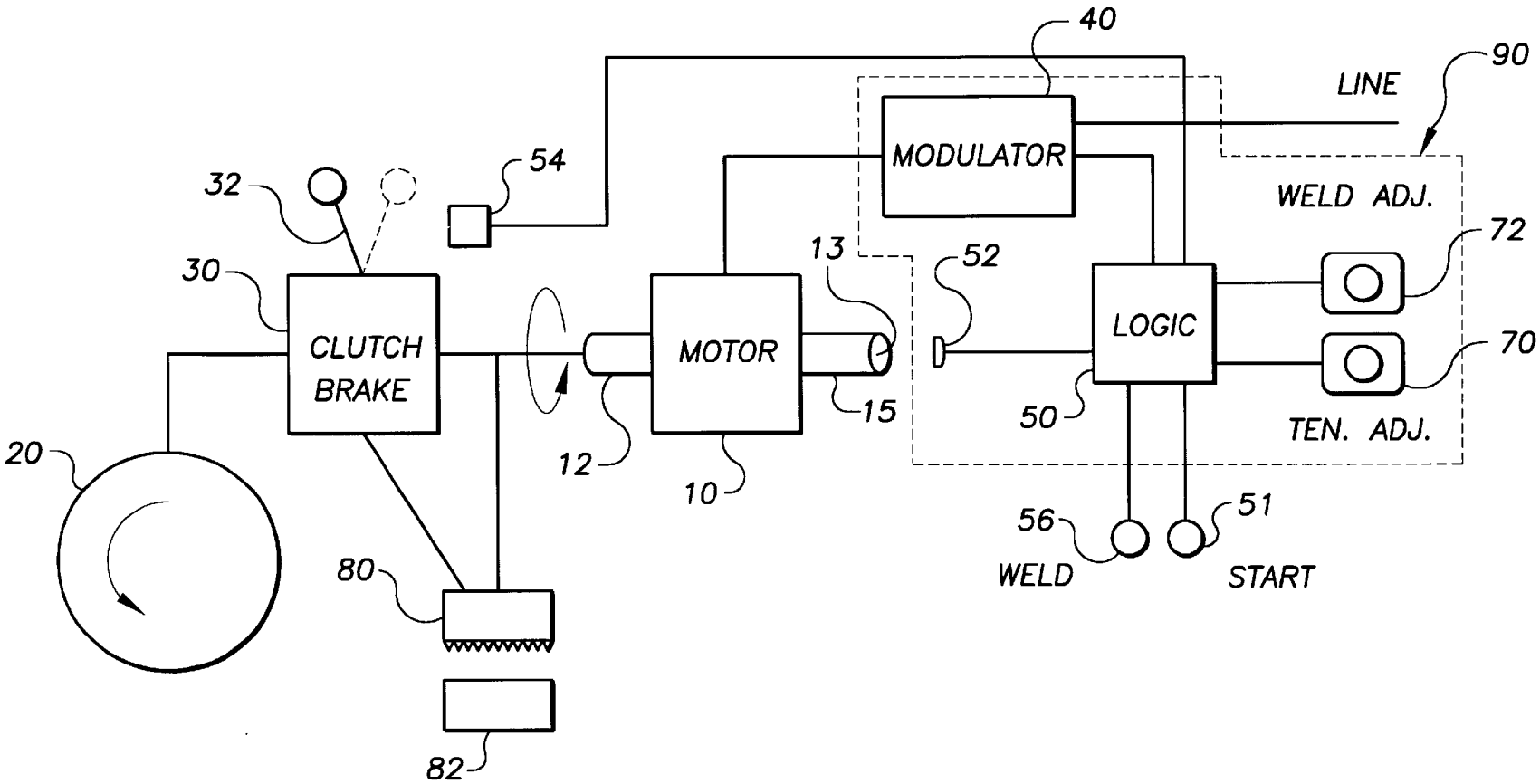
FIG. 1 is schematic view of an exemplary electric strap tensioning tool.

In FIG. 1, the exemplary electric strapping tool comprises an electric motor 10 coupled to a strap tensioning feed wheel 20 for imparting rotation thereto. The electric motor is preferably an AC electric motor, for example a universal brush motor, but in some embodiments the motor may be a DC electric motor.

In the exemplary embodiment, a clutch and brake assembly 30 couples an output drive shaft 12 of the electric motor 10 to the feed wheel 20. The assembly 30 includes a lever 32 actuatable between first and second positions by a tool operator for configuration thereof in feed wheel drive and braking modes. In the drive mode, the assembly 30 engages the feed wheel 20 with the electric motor 10 for strap tensioning operations. In the braking mode, the assembly 30 disengages the feed wheel 20 from the electric motor 10 and brakes rotation of the feed wheel to maintain tension applied previously to the strap.

Clutch and brake assemblies suitable for use with the present invention are already well known, for example those incorporated in the VXL and VXM 2000-Z TENSION-WELD pneumatic strapping tools by ITW Signode Glenview, Ill. Alternative embodiments may include other means for coupling the electric motor to the feed wheel.

The output of the electric motor 10 is generally dependent on the electric power supplied thereto. Tension applied to the strap during tensioning by the feed wheel depends upon and is controllable by controlling the electric power supplied to the electric motor, which drives the feed wheel. Strap tensioning may be initiated by actuating a user operated start switch 51 when the electric motor 10 is engaged with the feed wheel 20, as discussed above.

In the exemplary embodiment of FIG. 1, a modulator circuit 40 controls the supply of electric power from a power supply LINE to the electric motor 10 under the control of a logic circuit 50, which may be hardwired but preferably includes a programmable micro-controller or some other software-operated device, upon actuation of the start switch 51.

The electric motor is preferably disabled to prevent overheating after operating for some predetermined time interval, for example several seconds after actuation of the start switch 51. The time interval may correspond for example to a time interval required for completing a strap tensioning operation upon actuation of the start switch 51. The logic circuit 50 may include a timer and is preferably programmed for this purpose.

In one embodiment, the modulator circuit 40 is an electrical chopper circuit that controls AC electric power supplied from the power LINE to an AC electric motor. In another embodiment, modulator circuit 40 controls DC electric power applied to a DC electric motor. Electric power modulator circuits suitable for use with the present invention are well known.

In the exemplary embodiment of FIG. 1, the tool includes a user operable tension adjustment device 70, for example a potentiometer, coupled to the logic circuit 50 for adjusting or controlling electric power supplied to the electric motor 10. The tool operator may thus increase or decrease strap tension over some predetermine range upon adjustment of the device 70. In embodiments where the logic circuit 50 includes a software operable micro-controller, the range of strap tension controllable by the device 70 is programmable.

The tool also includes a detector 52 for detecting rotation of the motor armature or shaft during strap tensioning, for example a magnetic field detector located near a magnet disposed on the shaft. The magnetic field detector is coupled to the logic circuit 50.

Figure 2:
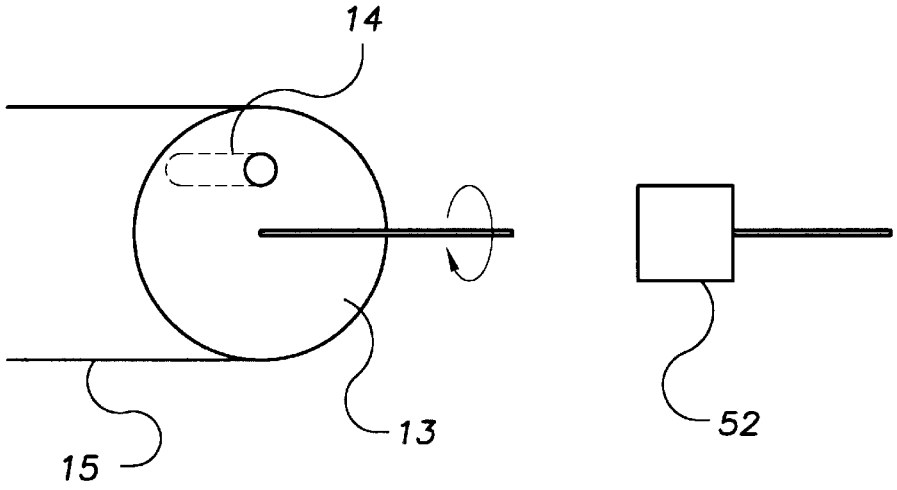
FIG. 2 is a detailed view of an exemplary rotation sensor.

In FIG. 2, a magnet 14 is disposed on a transverse end surface 13 of the rotating armature or shaft 15, and the magnet 14 is offset from the rotation axis thereof. The magnet 14 is preferably disposed in an axial opening formed in the shaft. Thus configured, the mass of the magnet 14 replaces material removed from the shaft 15 opening, thereby eliminating the need for counterbalancing. The magnet 14 is preferably retained magnetically in the opening of the shaft without other retention means. In other embodiments, however, the magnet may be located on other parts of the shaft, for example on a side portion thereof.

The detector 52 is located where it will detect changes in the magnetic field as the motor rotates. In FIGS. I and 2, the detector 52 is a magnetic field detector disposed near the shaft portion 15 housing the magnet, preferably near the transverse end 13 thereof and in axially alignment therewith. The exemplary magnetic field detector is preferably a Hall effect device, but in alternative embodiments other devices may also be used.

In one mode of tool operation, the modulator 40 provides electric power to the electric motor 10 for driving the feed wheel to apply a predetermined amount of strap tension. As strap tension increases, the rotational output of the electric motor 10 begins to decrease, and the decreasing rotation rate is detected by the detector 52.

When rotation of the motor armature or shaft is reduced to some predetermined rate or level, which corresponds to a desired strap tension, the logic circuit 50 signals the modulator circuit 40 to reduce power supplied to the electric motor 10. The reduced power supplied to the electric motor is sufficient only to maintain the tension previously applied to the strap until the electric motor is disengaged from the feed wheel and the brake is applied thereto upon actuation of the lever 32, as discussed above.

In the exemplary embodiment, the lever 32 operates a switch 54 coupled to the logic circuit 50 to indicate the configuration of the assembly 30. Upon reduction of electric power to the motor, the logic circuit preferably disables power supplied to the motor to prevent overheating if the logic circuit does not detect that the motor has been disengaged from the feed wheel and that the brake has been applied thereto, as indicated by the state of the switch 54. The logic circuit may include a timer and is preferably programmed for this purpose.

After completion of strap tensioning and upon braking rotation of the feed wheel, the tensioned strap may be secured by means known in the art, for example by friction welding. Other known fastening means may also be used. In the exemplary embodiment, the output shaft of the electric motor 10 is also coupled to and drives a vibrating welding jaw 80.

In one embodiment, the output shaft 12 of the electric motor 10 is coupled to the feed wheel 20 and to the weld gripper 80 when the motor rotates in the same direction, whereby the motor rotates the feed wheel and vibrates the welding jaw when the shaft rotates in the same direction, thus eliminating the requirement for operation of the motor in one direction to operate the feed wheel and in another reverse direction to operate the welding jaw as is required in prior art electric tensioning tools.

In the exemplary embodiment, the clutch and brake assembly 30 moves the welding jaw toward the support member 82 when the electric motor is disengaged from the feed wheel and the brake is applied thereto as is known.

The welding operation may be initiated upon actuation of a user operable weld switch 56 coupled to the logic circuit 50 after the electric motor 10 is disengaged from the feed wheel and the rotation thereof is braked by the assembly 30 to maintain tension on the strap. Prior to welding, the electric power supplied to the motor 10 is increased by the modulator circuit 40 under the control of the logic circuit 50 to increase the vibration of the welding jaw 80 for the welding operation. The logic circuit 50 may include a timer and is preferably programmed to control the weld time.

In the exemplary embodiment of FIG. 1, the tool includes a user operable weld time adjustment device 72, for example a potentiometer, coupled to the logic circuit 50 for adjusting or controlling the weld time. The tool operator may thus increase or decrease the weld time over some predetermine range upon adjustment of the device 70. In embodiments where the logic circuit 50 includes a software operable micro-controller, the range of weld time controllable by the device 72 is programmable.

After the welding operation is complete, the logic circuit 50 may disable the electric motor 10. The logic circuit also preferably disables the electric motor to prevent overheating if the weld switch 72 is not actuated within a predetermined time interval after disengaging the motor from the feed wheel and applying the brake thereto by actuation of the lever 32. The logic circuit may include a timer and is preferably programmed for this purpose.

After completion of the welding operation, the lever 32 is preferably moved back to the position where the clutch and brake assembly 30 re-engages the motor 10 with the feed wheel 20 and releases the brake applied thereto. This corresponding movement of the lever 32 is detected by the logic circuit 50 upon release of the switch 54, or alternatively by actuation of another switch. Thereafter, the logic circuit signals the modulator circuit to apply a short pulse of electric power to the motor, which has been re-engaged with the feed wheel.

The short pulse applied to the motor jogs the feed wheel to free it from the tensioned and welded strap, which facilitates subsequent release of the tensioning tool therefrom.

Figure 3:
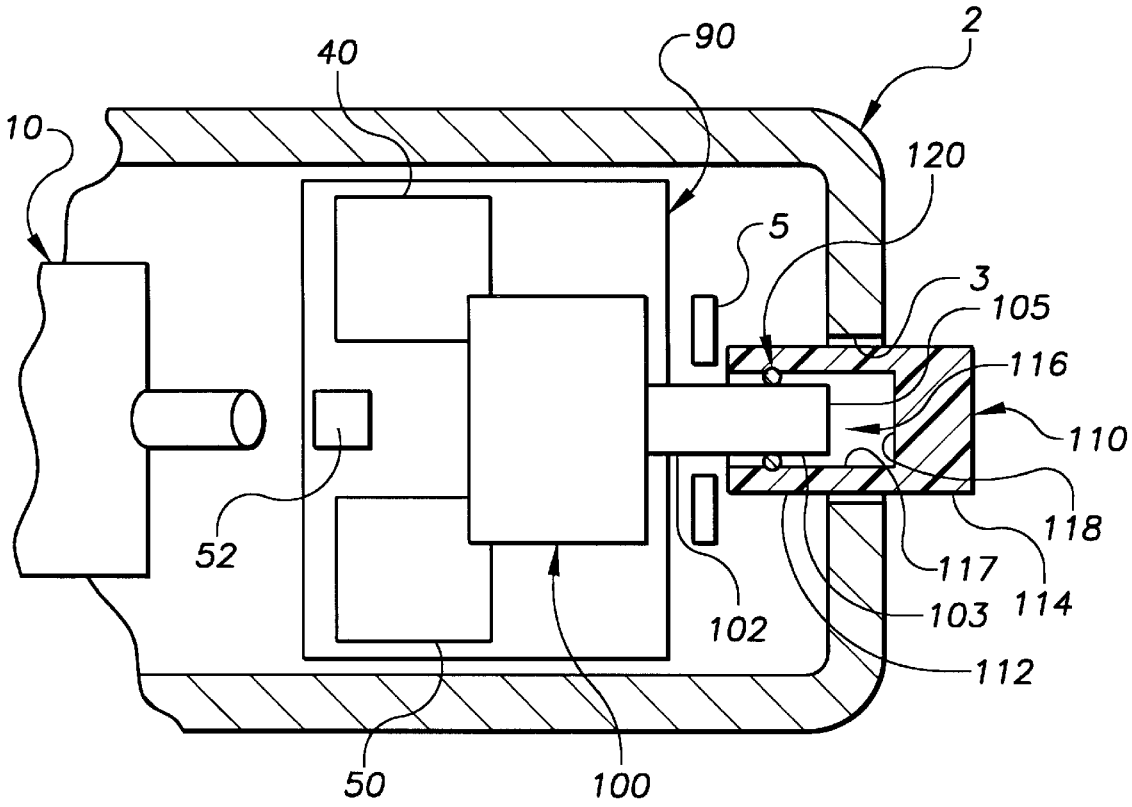
FIG. 3 is a partial sectional view of an exemplary control knob.

In FIG. 3, the modulator and logic circuits 40 and 50, detector 52, control devices, and most other electronics of the tensioning tool are preferably assembled in a single electronics module 90 that may be mounted in a housing 2 of the tool adjacent the electric motor 10. An output of the module is coupled to the electric motor with appropriate connectors, as are any switches that must be located apart therefrom.

The exemplary weld and tension adjustment potentiometers 70 and 72 are also preferably mounted on the module 90 and made accessible to the tool user by corresponding knobs discussed further below. The weld and start switches may also be part of or mounted on the module 90 and made accessible by the user.

FIG. 3 illustrates a strapping tool parameter adjustment member or device 100 having a rotatable stem 102 disposed at least partially in the housing 2, and preferably mounted on or as a portion of the electronics module 90. In the exemplary embodiment, the parameter adjustment device 100 corresponds for example to one of the tension or weld adjustment potentiometers 70 or 72 of FIG. 1.

FIG. 3 also illustrates a control knob 110 having a first end portion 112 and a second opposite user accessible end portion 114 protruding from an opening 3 of the housing.

The first end portion 112 of the control knob has an opening 116 therein for receiving a portion of the stem 102 of the adjustment device 100.

A substantially annular resilient member 120, for example an o-ring, is disposed between and frictionally engaged with the stem 102 and the control knob 110. More particularly, the ring member 120 is disposed between an axial surface portion 103 of the stem 102 and an axial surface portion 117 of the stem opening, thereby coupling the stem to the control knob. In some embodiments, one of the stem or the control knob opening may include an annular groove or recess therein to seat the annular resilient member.

In operation, the user may grasp and rotate the end portion 114 of the control knob in either direction to operate the corresponding control device. The stems of some control devices, for example many potentiometers, have a limited range of rotation. The annular resilient member permits rotational slippage of the control knob relative to the stem without damage thereto when the stem has been positioned at either of its rotational limits.

The stem 103 of the adjustment member has a transverse end surface 105 that is preferably spaced apart from a transverse end 1 18 of the control knob opening. The annular resilient member permits axial slippage of the control knob relative to the stem without damage thereto when the stem is subject to an axial force, as is common with tensioning tools. The housing preferably includes some rigid structure 5 therein to limit the axial movement of the stem before the end 105 of the stem contacts the end 118 of the control knob opening.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. An electric strapping tool comprising:

a strap tensioning feed wheel;

an electric motor having an output shaft coupled to the feed wheel a logic circuit;

an output shaft rotation sensor coupled to the logic circuit;

a modulator circuit coupled to a power input of the electric motor, the modulator circuit coupled to the logic circuit, whereby the modulator circuit provides no more power to the electric motor than is required to maintain the feed wheel substantially rotationally fixed when the output shaft rotation is at a specified level under load.

2. The tool of claim 1, the electric motor is an AC machine and the modulator circuit is a chopper circuit.

3. The tool of claim 1, a welding jaw, the output shaft of the electric motor coupled to the welding jaw.

4. The tool of claim 3, a lever operable clutch and brake assembly coupling the output shaft of the motor to the feed wheel.

5. The tool of claim 1, a magnet disposed on the shaft of the electric motor, a magnetic field detector located near the magnet, an output of the magnetic field detector coupled to the logic circuit.

6. The tool of claim 5, the magnet disposed on an end surface of the shaft transverse to and offset from a rotation axis thereof, the magnetic field detector is a Hall effect device disposed near the end of the shaft.

7. The tool of claim 1, a vibratable welding jaw, the output shaft of the electric motor coupled to the feed wheel and to the welding jaw, whereby the electric motor rotates the feed wheel and vibrates the welding jaw when the shaft rotates in the same direction.

8. The tool of claim 1, the modulator circuit for providing a reduced power to the electric motor after the output shaft rotation is reduced to the specified level.

9. The tool of claim 8, the logic circuit for disabling power supplied to the electric motor after a predetermined time interval occurring after the modulator circuit provides no more power to the electric motor than is required to maintain the feed wheel substantially rotationally fixed.

10. The tool of claim 1, the modulator circuit for providing a first power to the electric motor when the output shaft rotation is greater than the specified level, the modulator circuit for providing no more power to the electric motor than necessary to balance a load applied to the feed wheel when the output shaft rotation is at a specified level.

11. An electric strapping tool comprising:

an electric motor having a rotatable shaft, the shaft having a generally cylindrical outer surface disposed about a rotation axis of the shaft, the shaft having an end surface extending from the cylindrical outer surface to the rotation axis thereof;

a magnet disposed on the end surface of the shaft and offset from the rotation axis thereof;

a magnetic field detector disposed near the shaft, whereby rotation of the shaft is detectable by the magnetic field detector.

12. The tool of claim 11, an opening in the end surface of the shaft, the magnet disposed at least partially in the opening.

13. The tool of claim 11, the magnetic field detector is a Hall effect device.

14. The tool of claim 11, the magnet is disposed in an axial opening in the shaft, the detector is disposed near the end surface of the shaft and aligned generally axially therewith.

15. An electric strapping tool comprising:

a rotatable strap tensioning feed wheel;

a vibratable welding jaw;

an electric motor having an output shaft coupled to the feed wheel and to the welding jaw, the electric motor for rotating the feed wheel and vibrating the welding jaw when the electric motor output shaft rotates in the same direction;

a logic circuit;

an electric motor rotation sensor coupled to the logic circuit;

an electric motor power modulator circuit coupled to tie logic circuit, the electric motor power modulator circuit coupled to a power input of the electric motor, the electric motor power modulator circuit for reducing power to the electric motor when a predetermined electric motor rotation is detected by the electric motor rotation sensor.

16. The tool of claim 15, a magnet disposed on the shaft of the electric motor, the electric motor rotation sensor is a magnetic field detector located near the magnet.

17. The tool of claim 16, the magnet disposed on a substantially transverse end of the shaft and offset from a rotation axis thereof, the magnetic field detector is a Hall effect device disposed near the end of the shaft.

18. An electric strapping tool comprising:

a strap tensioning feed wheel;

an electric motor having an output shaft coupled to the feed wheel;

a logic circuit;

an electric motor output shaft rotation sensor coupled to the logic circuit;

a modulator circuit coupled to a power input of the electric motor, the modulator circuit coupled to the logic circuit, the modulator circuit for providing no more power to the electric motor than necessary to balance a load on the feed wheel after the output shaft rotation is reduced to a specified level.

19. The tool of claim 18, the modulator circuit for providing a first power to the electric motor when the output shaft rotation is greater than the specified level, the modulator circuit for providing a reduced power to the electric motor after the output shaft rotation is reduced to the specified level.

20. The tool of claim 18, the modulator circuit for providing a strap tensioning power to the electric motor sufficient to rotate the feed wheel under a load when the output shaft rotation is greater than the specified level, the modulator circuit for providing reduced power to the electric motor sufficient to maintain the feed wheel in a substantially fixed position after the output shaft rotation is reduced to the specified level.

21. The tool of claim 20, the logic circuit for disabling power supplied to the electric motor after a predetermined time interval occurring after the modulator circuit provides reduced power to the electric motor.

22. The tool of claim 18, the modulator circuit for providing reduced power to the electric motor sufficient to maintain the feed wheel in a substantially fixed position after the output shaft rotation is reduced to the specified level.

23. The tool of claim 18, a vibratable welding jaw, the output shaft of the electric motor coupled to the feed wheel and to the welding jaw when the output shaft rotates in a first direction, the electric motor for concurrently rotating the feed wheel and vibrating the welding jaw when the electric motor output shaft rotates in the first direction.

24. The tool of claim 18, the electric motor output shaft having an end surface non-parallel to an axial dimension of the shaft, a magnet disposed in the end surface of the electric motor output shaft, the electric motor output shaft rotation sensor is a magnetic sensor.

25. The tool of claim 18, a clutch interconnecting the electric motor output shaft and the strap tensioning feed wheel, the clutch for disengaging the electric motor output shaft from the strap tensioning feed wheel when the modulator circuit provides no more power to the electric motor than necessary to balance a load on the feed wheel.

26. The tool of claim 25, the modulator circuit for applying a short power pulse to the electric motor when the electric motor output shaft is re-engaged with the strap tensioning feed wheel.

* * * * *